US005682914A

United States Patent [19]

Simlesa

[11] Patent Number: 5,682,914

[45] Date of Patent: Nov. 4, 1997

[54] BAG FOR CLEANING PISTONS

[76] Inventor: Ante Simlesa, Vukovarska 181, 21000 Split, Croatia

[21] Appl. No.: 643,376

[22] Filed: May 6, 1996

[51] Int. Cl.[6] ..... B08B 3/04

[52] U.S. Cl. ..... 134/186; 134/102.2; 134/182

[58] Field of Search ..... 134/102.2, 114, 134/182, 186, 200

[56] References Cited

U.S. PATENT DOCUMENTS

| | | | |
|---|---|---|---|
| 3,982,965 | 9/1976 | Spotz | 134/200 X |
| 4,369,801 | 1/1983 | Jones et al. | 134/58 R |
| 4,408,625 | 10/1983 | Kuhl | 134/144 |
| 4,791,947 | 12/1988 | Holzberger | 134/123 |
| 5,035,516 | 7/1991 | Pacheco | 134/200 X |
| 5,353,823 | 10/1994 | Peter | 134/182 X |

*Primary Examiner*—Philip R. Coe
*Attorney, Agent, or Firm*—Richard L. Miller, P.E.

[57] ABSTRACT

An apparatus for cleaning a piston is provided and consists of a container made from a flexible waterproof material having an open bottom end and an open top end. A mechanism is provided for sealing the open bottom end of the container about the skirt of the piston. A device is provided for supporting the open top end of the container above the head of the piston so that water can be introduced into the container through the open top end to cover the ring grooves and the head of the piston. An apparatus is provided for agitating the water within the container so that the water can clean the ring grooves and the head of the piston, and a drain is provided for emptying the dirty water out from the container.

5 Claims, 1 Drawing Sheet

BAG FOR CLEANING PISTONS

BACKGROUND OF THE INVENTION

The instant invention relates generally to cleaning devices and more specifically it relates to an apparatus for cleaning a piston.

Numerous cleaning devices have been provided in the prior art that are adapted to perform various cleaning tasks. For example, U.S. Pat. Nos. 4,369,801 to Jones et al.; 4,408,625 to Kuhl; and 4,791,947 to Holzberger all are illustrative of such prior art. While these units may be suitable for the particular purpose to which they address, they would not be as suitable for the purpose of the present invention as heretofore described.

SUMMARY OF THE INVENTION

A primary object of the present invention is to provide an apparatus for cleaning a piston that will overcome the shortcomings of the prior art devices.

Another object is to provide an apparatus for cleaning a piston that will remove combustion products from the head of the piston by utilizing water agitated by air pressure.

An additional object is to provide an apparatus for cleaning a piston that will avoid any mechanical damage to the piston when the piston is cleaned.

A further object is to provide an apparatus for cleaning a piston that is simple and easy to use.

A still further object is to provide an apparatus for cleaning a piston that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
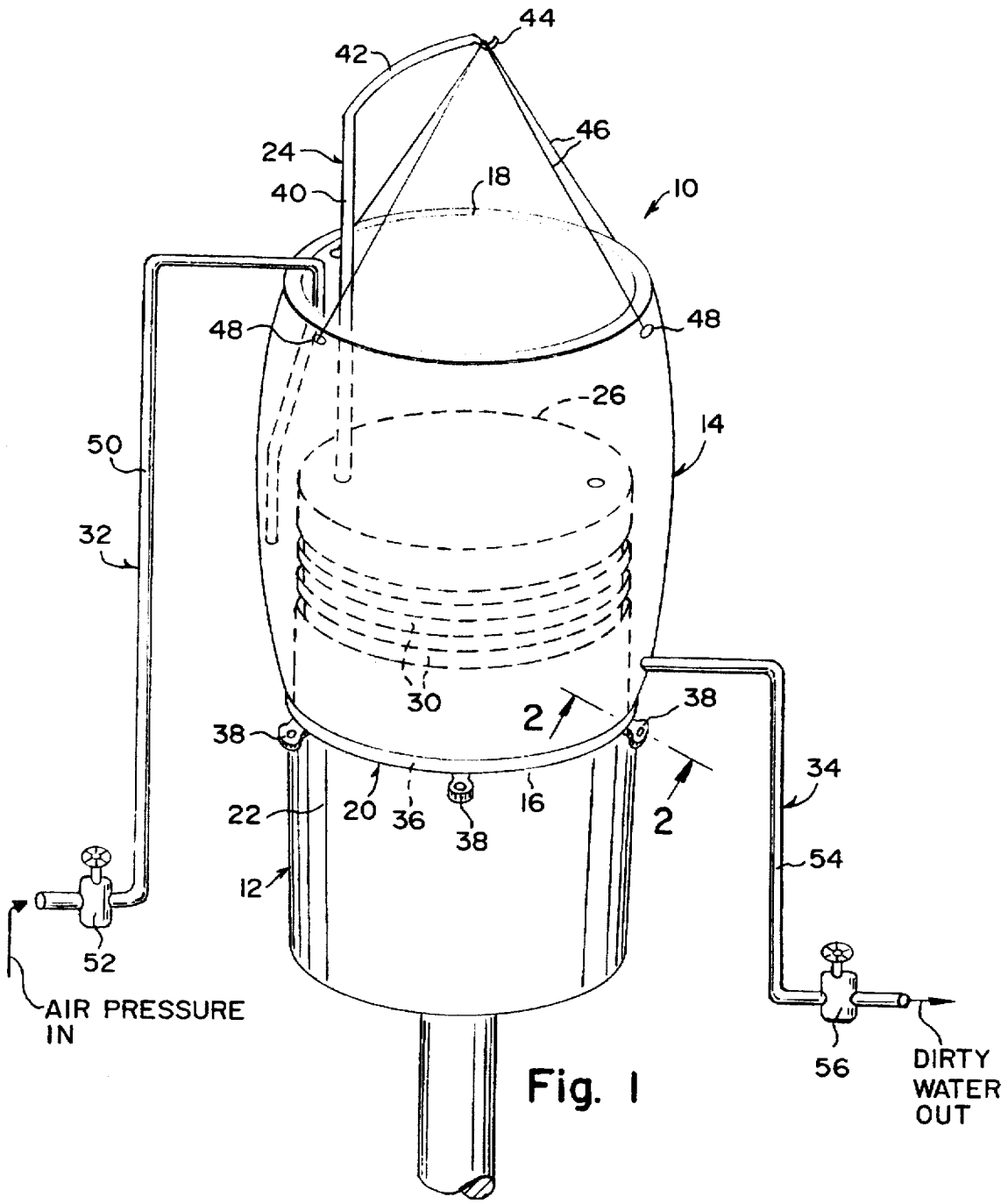
FIG. 1 is a diagrammatic perspective view of the instant invention in use.
Figure 2:
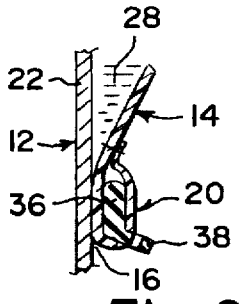
FIG. 2 is a cross sectional view taken on line 2—2 in FIG. 1.

Turning now descriptively to the drawings, in which similar reference characters denote similar elements throughout the several views, the Figures illustrate an apparatus 10 for cleaning a piston 12 consisting of a container 14 made from a flexible waterproof material having an open bottom end 16 and an open top end 18. A mechanism 20 is for sealing the open bottom end 16 of the container 14 about the skirt 22 of the piston 12. A device 24 is for supporting the open top end 18 of the container 14 above the head 26 of the piston 12 so that water 28 can be introduced into the container 14 through the open top end 18 to cover the ring grooves 30 and the head 26 of the piston 12. An apparatus 32 is for agitating the water 28 within the container 14 so that the water 28 can clean the ring grooves 30 and the head 26 of the piston 12. An emptying mechanism 34 is for draining the dirty water 28 out from the container 14.

The sealing mechanism 20 includes an elastic band 36 affixed about the open bottom end 16 of the container. A plurality of pull tabs 38 are spaced apart and extend from the elastic band 36 so that the elastic band 36 can be placed onto and removed from the skirt 22 of the piston 12.

The supporting mechanism 24 includes a stanchion 40 having a curved upper portion 42 with a hook member 44 thereon. The stanchion 40 extends upwardly from the head 26 of the piston 12 so that the hook member 44 is elevated above the open top end 18 of the container 14. A plurality of guy wires 46 extend downwardly from the hook member 46 of the stanchion 40 to connect at 48 to the open top end 18 of the container 14, to support the open top end 18.

The agitating apparatus 32 includes an elongated inlet pipe 50 extending into the open top end 18 of the container 14 and to the ring grooves 30 of the piston 12. A valve 52 is on the inlet pipe which when opened will allow air under pressure to enter into the water 28 within the container 14 to agitate the water 28.

The draining mechanism 34 includes an elongated drain pipe 54 extending from the side of the container 14 proximate the bottom end 16 thereof. A valve 56 is on the drain pipe 54 which when opened will allow the dirty water 28 within the container to drain out therefrom.

For best results the head 26 and ring grooves 30 of the piston 12 should be soaked and agitated by the water 28 for approximately two hours. The container 14 is then removed so that the piston 12 can be cleaned and dried with a rag.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A fixture for cleaning a piston which comprises:

a) a container made from a flexible waterproof material having an open bottom end and an open top end;

b) means for sealing the open bottom end of said container about the skirt of the piston;

c) means for supporting the open top end of said container above the head of the piston so that water can be introduced into said container through the open top end to cover the ring grooves and the head of the piston;

d) means for agitating the water within said container so that the water can clean the ring grooves and the head of the piston; and e) means for draining the dirty water out from said container.

2. The fixture as recited in claim 1, wherein said sealing means includes:

a) an elastic band affixed about the open bottom end of said container; and b) a plurality of pull tabs spaced apart and extending from said elastic band so that said elastic band can be placed onto and removed from the skirt of the piston.

3. The fixture as recited in claim 2, wherein said supporting means includes:

a) a stanchion having a curved upper portion with a hook member thereon, said stanchion extending upwardly above the head of the piston so that the hook member is elevated above the open top end of said container; and b) a plurality of guy wires extending downwardly from the hook member of said stanchion to connect to the open top end of said container to support the open top end.

4. The fixture as recited in claim 3, wherein said agitating means includes:

a) an elongated inlet pipe extending into the open top end of said container and to the ring grooves of the piston; and b) a valve on said inlet pipe which when opened will allow air under pressure to enter into the water within said container to agitate the water.

5. The fixture as recited in claim 4, wherein said draining means includes:

a) an elongated drain pipe extending from the side of said container proximate the bottom end thereof; and b) a valve on said drain pipe which when opened will allow the dirty water within said container to drain out therefrom.

* * * * *